United States Patent [19]

Dean et al.

[11] 4,426,276

[45] Jan. 17, 1984

[54] COMBINED FLUID CATALYTIC CRACKING AND HYDROCRACKING PROCESS

[76] Inventors: Robert R. Dean, #1 Columbine La., Littleton, Colo. 80123; Jean-Louis Mauleon, 15656 E. Grand Ave., Aurora, Colo. 80015

[21] Appl. No.: 486,802

[22] Filed: Apr. 20, 1983

Related U.S. Application Data

[63] Continuation of Ser. No. 359,154, Mar. 17, 1982, abandoned.

[51] Int. Cl.[3] ..... C10G 69/02; C10G 69/04; C10G 69/06

[52] U.S. Cl. ..... 208/60; 208/68; 208/70; 208/93

[58] Field of Search ..... 208/60, 68, 70, 93

[56] References Cited

U.S. PATENT DOCUMENTS

| | | | |
|---|---|---|---|
| 3,530,060 | 9/1970 | Offenhauer | 208/68 |
| 3,726,789 | 4/1973 | Kouach | 208/68 |
| 3,826,736 | 7/1974 | Kittrell | 208/60 |
| 3,869,378 | 3/1975 | Pollock et al. | 208/68 |
| 4,207,167 | 1/1980 | Bradshaw | 208/68 |

*Primary Examiner*—Curtis R. Davis
*Attorney, Agent, or Firm*—Carl D. Farnsworth

[57] ABSTRACT

An integrated combination of fluid catalytic cracking and hydrocracking select fractions of crude oil and FCC cycle oils to conserve hydrogen process requirements in the production of gasoline is discussed. Liquid products of hydrocracking are separated into low boiling components and a high boiling fraction is recycled to the FCC operation. Select fractions obtained from hydrocracking, FCC and crude oil distillation are upgraded by reforming and alkylation.

20 Claims, 1 Drawing Figure

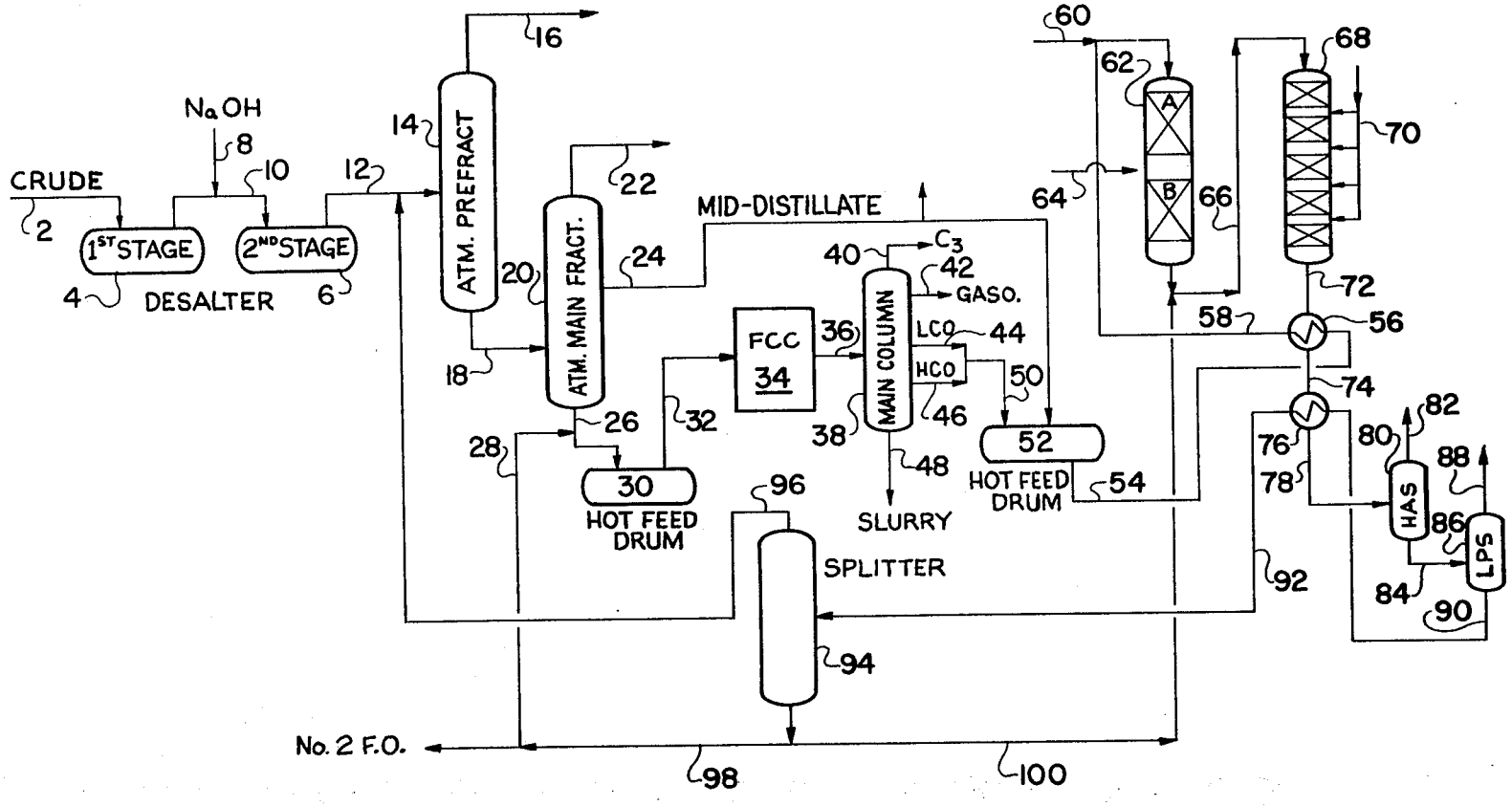
CRUDE
NaOH
1ST STAGE
2ND STAGE
DESALTER
ATM. PREFRACT.
ATM. MAIN FRACT.
MID-DISTILLATE
FCC
MAIN COLUMN
GASO.
LCO
HCO
HOT FEED DRUM
SLURRY
SPLITTER
HAS
LPS
No. 2 F.O.

COMBINED FLUID CATALYTIC CRACKING AND HYDROCRACKING PROCESS

This application is a continuation of application Ser. No. 6/359,154, filed 3/17/82, and now abandoned.

BACKGROUND OF THE INVENTION

The present invention relates to a combination process for upgrading high boiling portions of crude oil by catalytic cracking and hydrocracking. Some prior art patents having a bearing on the subject are identified below:

U.S. Pat. No. 2,911,352 is directed to a process for producing high octane naphtha by the combination of catalytic cracking, desulfurization, and hydrocracking.

U.S. Pat. No. 2,939,836 is directed to the destruction of heavy crude oils obtained from catalytic cracking by hydrocracking a product fraction boiling above 260° C. (500° F.).

U.S. Pat. No. 3,072,560 is directed to a combination process for conversion of residual oils to gasoline by coking, hydrocracking, catalytic cracking, hydrocracking and reforming.

U.S. Pat. No. 3,193,488 is directed to a combination catalytic cracking and hydrocracking process involving two separate stages of catalytic cracking and hydrocracking a solvent oil extract of a high boiling product of catalytic cracking.

U.S. Pat. No. 3,349,023 is directed to a combined cracking process for maximizing middle distillate production by thermal cracking and hydrocracking.

U.S. Pat. No. 3,983,029 is directed to a combination process comprising hydrotreating a hydrocarbon feed boiling above 200° F. before hydrocracking thereof. The hydrocracked product is fractionated to produce a 180°-400° F. fraction passed to catalytic reforming and a 550° F. plus fraction either charged to catalytic cracking or recycled to either the hydrocracking zone or the hydrotreating zone.

U.S. Pat. No. 3,185,639 relates to a combination process for upgrading crude oil which comprises deasphalting atmospheric tower bottoms before catalytic cracking, separating the product of catalytic cracking to obtain a fraction product, and of hydrofining light and heavy atmospheric gas oils in combination with light and heavy cycle oils of catalytic cracking before hydrocracking thereof.

SUMMARY OF THE INVENTION

The present invention is directed to an integrated combination process for upgrading crude oil to produce lower boiling materials comprising gasoline boiling range products. More particularly, the combination process of the present invention generally relies upon the sequence of fluid catalytic cracking followed by hydrocracking of selected feed materials higher boiling than gasoline range products. The liquid products of hydrocracking are separated at a boiling point in the range of 400° to 600° F. to recover a low boiling product fraction recycled to a crude atmospheric distillation tower with a higher boiling fraction with an initial boiling point in the range of 400° to 600° F. being recycled to the fluid catalytic cracking unit. Cycle oils of fluid catalytic cracking with or without a straight run middle distillate fraction of the crude oil are desulfurized and hydrocracked.

In the processing sequence above briefly defined, the fluid catalytic cracking unit is relied upon to accomplish a selective cracking operation including substantial desulfurization, denitrogenation and dematalization of higher boiling portions of the crude oil charge to be subsequentially hydrocracked. In a more particular embodiment, partially desulfurized light and heavy cycle oils of fluid catalytic cracking are further desulfurized and denitrogenated to form hydrogen sulfide and ammonia before affecting hydrocracking thereof in the presence of a zeolite containing hydrocracking catalyst to hydrogenate and crack polycyclic compounds in the hydrocracking and the fluid catalytic cracking steps of the combination operation to produce gasoline boiling range product material.

The synergistic contributions of the combination process comprising a zeolite fluid catalytic cracking operation in combination with a downstream hydrocracking operation, hydrocracking a desulfurized-denitrogenated cycle oil product of fluid catalytic cracking boiling above gasoline boiling range material and subjecting a product of hydrocracking boiling above about 400° to 600° F. to the fluid catalytic cracking operation of the combination which hydrogenated fraction contributes significantly and measurably to the production of gasoline of acceptable octane rating as well as gaseous components convertible to gasoline boiling components. Furthermore, the cyclic flow of the combination operation contributes significantly to the production of dicylic components recoverable in LCO from higher boiling polycyclic compounds as well as gasoline boiling range components of acceptable octane rating.

In a particular aspect the integrated combination operation of this invention is concerned with utilizing demetalization desulfurization and denitrogenization aspects of a fluid catalytic cracking operation to provide a relatively clean feed material boiling above about 400° F. of substantially reduced sulfur and nitrogen content as well as reduced metallo-organic compounds as an oil change or feed to a downstream hydrocracking operation comprising catalytic desulfurization and denitrogenation operations for cycle oils which further reduces residual sulfur and particularly nitrogen in the feed to a level of about 10 ppm. The 400° F. plus clean feed material thus desulfurized and denitrogenated is thereafter subjected to a selective hydrocracking operation employing preferably a zeolite containing hydrocracking catalyst or other suitable catalyst maintained under operation conditions of temperature and pressure which will particularly reduce multicyclic compounds to lower orders of cyclic compounds comprising gasoline boiling range components and provide hydrogenated higher boiling polycyclic compounds in the range of 2 to 5 ring components ultimately converted by the combination cracking operations to mono and dicyclic aromatics. A hydrocracked product boiling above a selected boiling range herein defined is recycled as a hydrogenated product to the fluid cracking operation for catalytic conversion thereof in the presence of a reduced crude oil charge boiling above a middle distillate fraction of the crude oil as herein defined to produce gasoline and lower boiling range product components and cycle oils. The selected recycled product of hydrocracking, herein defined as having an IBP in the range of about 400° F. up to about 600° F., is mixed with atmospheric bottoms from crude oil distillation generally boiling above about 600° F. to provides a source of labile hydrogen from hydrocracking suitable for effecting hydrogen transfer reactions during the fluid catalytic cracking of the high boiling fresh feed residual oil portion of crude oil charged feed. In this combination the fresh residual oil feed is demetallized while also effecting desulfurization and denitrogenation of the charged residual oil. Thus the hydrocracking operation is a hydrogen contributor to residual oil conversion processed in a special reduced crude cracking operation herein below more particularly discussed.

In view of the synergistic contributions between the special combination of cracking operations and desulfurizing operations herein defined and the conditions of operation of the individual steps, it is evident that they may be considerably varied to particularly emphasize the production of gasoline boiling range material and/or middle distillates in response to seasonal changes particularly requiring more or less of the products of the combination operation.

The combination process of this invention is considered economically advantageous and synergistically efficiently cooperative in hydrogen utilization in the following manner: 1. A feed charged to hydrotreating will normally further hydrogen enrich the front end of the feed which is already rich in hydrogen, whereas in the particular fluid cracking/hydrotreating/hydrocracking steps of the combination process of this invention, cycle oil products of hydrocracking will artificially hydrogen enrich particularly the heavier portions of the crude residual oil feed charged to fluid catalytic cracking operation. This process combination therefore provides for a more efficient use of within process generated hydrogen as discussed herein.

2. Hydrotreating/hydrocracking the cycle oils of FCC requires considerably less hydrogen than hydrotreating the total crude oil feed portion thus making for greater use optimization of available hydrogen.

3. In the combination of this invention the FCC unit is regarded as a pivotal unit in the overall refinery operation. That is, compared to hydrotreating the total feed, the FCC operation is more efficient, as well as an economically more attractive process for use as a residual oil "cleaning up" process unit. That is, metals, solids, and Conradson carbon components are removed continuously as well as more efficiently and economically from a crude residual oil portion comprising vacuum tower bottoms charged to a fluid catalytic cracking operation.

4. Recycling of a select hydrogenated product fraction from a hydrocracking operation to the FCC operation improves substantially the equilibrium flash characteristics of the higher boiling portion of a reduced crude, thus allowing for a better catalytic conversion thereof by effectively lowering the required feed pseudo-critical operating temperature.

5. Using the Fluid Catalytic Cracking Unit (FCCU) as a pivotal process in the overall cracking combination as herein provided requires at least 60 percent less hydrogen to produce desired upgraded products when compared to an operation employing total feed hydrotreating. The combination operation of this invention allows the refiner to stay in more complete hydrogen balance with the hydrogen produced from the selective cracking operations of the invention in combination with that obtained from naphtha reforming.

6. The efficient and economic upgrading of a crude oil into gasoline producing components is directly related to the optimized utilization of hydrogen transfer reactions. The combination operation of the invention particularly identifies a most efficient utilization of available hydrogen by the combination of;

(1) hydrogen production through naphtha reforming, (2) hydrogen transfer redistribution through fluid catalytic cracking in the presence of a hydrogen donor material, (3) hydrogen absorption through cycle oils of hydrocracking transferred to catalytic cracking, and (4) hydrogen transfer from isobutane to olefins through alkylation.

Thus a combination operation of selective distillations, naphtha reforming, light product olefin alkylation, the combination of selective catalytic cracking of a residual oil or a reduced crude in the presence of cycle oil of hydrocracking in cooperation with FCC cycle oil hydrocracking with or without the presence of a crude oil middle distillate provides for a highly efficient and integrated hydrogen redistribution combination operation for upgrading residual or reduced crude oils into high yields of gasoline boiling range materials.

The processing combination of the diagrammatic drawing of FIG. 1, may be modified to eliminate one or both of separation zones 14 and 20 discussed below so that a desalted crude oil or one of low salt content can be charged to an atmospheric distillation tower. On the other hand, all or only a portion thereof comprising n-$C_6$ plus hydrocarbons and comprising higher boiling crude oil component materials may be charged as a feed to the fluid catalytic cracking operation in the manner herein identified. Other modifications and variations in the combination process are more specifically discussed below.

In any of the operation combinations herein particularly identified, it is intended that sodium and other water-soluble alkaline metals of the crude oil be reduced to a level of about 2 ppm commensurate with maintaining acceptable economic processing conditions before charging the fresh reduced crude feed to the process combination and particularly the (FCC) fluid catalytic cracking operation. The FCC operation of this invention is a special FCC operation identified below for processing residual oils and reduced crudes comprising metals and/or Conradson carbon producing components. In a particular embodiment, the FCC unit is more particularly identifiable with that disclosed in copending application Ser. No. 169,086 filed July 15, 1980, now U.S. Pat. No. 4,332,674 and that of application Ser. No. 324,450 filed on Nov. 24, 1981 the subject matter of which is incorporated herein by reference thereto. The FCC fluid cracking operation of this invention is therefore a particularly selective crystalline zeolite catalyst cracking operation concerned with cracking high boiling portions of a crude oil charge comprising a reduced crude, a residual oil portion of the crude boiling above about 600° F., or a portion of a reduced crude oil comprising material boiling above vacuum gas oils such as a vacuum resid containing metallo-organic compounds of multicyclic compositions of 3 to 6 adjoined ring configuration and boiling above about 1025° F. and more usually boiling above 1050° to 1100° F.

A further desulfurization and denitrogenation of a product of the fluid cracking operation boiling above about 400° F. with or without the presence of a separated crude oil middle distillate fraction such as a straight run or atmospheric fraction of the crude oil charge is accomplished under elevated exothermic temperature conditions generally restricted in the range of about 600° F. up to about 800° F. and a pressure above about 1000 psig, it being preferred to restrict the pressure thereof below about 3000 psig. The further desulfurization and denitrogenation of the identified high boiling oil charge is accomplished with a catalyst suitable for the purpose and known in the prior art such as a catalyst comprising cobalt-molybdenum, nickel tungsten or a nickel-molybdenum. Since a substantial portion of sulfur and nitrogen in the charge is effectively removed from the 600° F. plus material in the hydrogen transfer FCC operation of this invention, the severity of the further downstream desulfurization-denitrogenation operation may be more critically optimized to recover a product therefore comprising no more than about 10 ppm total nitrogen and 10 ppm combined sulfur.

In addition, to the above, the sequence of FCC and desulfurizing steps herein identified increase the API gravity of the cycle oil product of FCC from 5 to 10 numbers by the subsequent desulfurizing step to provide a demetallized feed more suitable for charging to a hydrocracking operation and comprising FCC cycle oil with or without crude oil middle ditillate material boiling from about 400° F. up to about 600° F. The desulfurized cycle oil products of fluid catalytic cracking boiling above about 400° F. of reduced metals, residual sulfur and nitrogen components with or without admixture with a middle distillate of the crude oil feed as herein provided is thereafter hydrocracked at a temperature restricted to within the range of about 650° to about 800° F., and a pressure in the range of about 1000 psig up to about 3500 psig, but preferably in the range of about 1500 psig up to about 2500 psig. Hydrocracking is generally regarded as a severe hydrogenation operation since it occurs at temperatures high enough to affect some catalytic cracking of charged hydrocarbons and is promoted by a catalyst composition comprising active crystalline zeolite catalytic component material. The course of the reaction and products obtained depend upon the composition of the feed charged as well as catalyst composition and on the relative rates of the hydrogenation and cracking reactions promoted therein. When charging a paraffinic feed, the hydrogen functions to saturate a primary olefinic product of the cracking reaction and thus prevents significant condensation reactions from occurring to the refractory polycyclic molecules. Furthermore, at the relatively low temperatures of hydrocracking, the hydrogenation of multi-ring aromatics is favored at the expense of producing a low octane gasoline. However, at more severe hydrocracking conditions, the rates of cracking increase faster than the rates of hydrogenation and materials such as tetralin crack to form lower forms of cyclic hydrocarbons. Thus, when hydrogenation of polycyclics is desired, the pressure of the operation must be high enough for the equilibriums to be favorable. In the particular synergistically integrated fluid catalytic cracking-hydrocracking combination operation of this invention and the composition of feeds charged thereto, cracking and hydrogenation operations of the separate cracking operations are selectively maintained and optimized to promote the hydrogenation and cracking of at least dicyclic and particularly multi-ring compounds to dicyclic ring compounds and particularly monocyclic compounds useful in producing high yields high octane of gasoline boiling range product. The catalyst employed in a sequence of catalyst beds in the hydrocracking zone is preferably a zeolite containing hydrocracking catalyst and is selected from one commercially available in the industry. That is, the catalyst employed in the hydrocracking zones is providing hydrogenation-dehydrogenation activity deposited upon an otherwise inactive support or on an active working or cracking support material and preferably is one comprising a crystalline zeolite cracking component. The cracking component may also comprise a second acidic material such as silica-alumina, silica-magnesia, silica-alumina-zirconia, alumina-boria, various acid treated clays and halogenated composites. The hydrogenation-dehydrogenation components may be selected from one or more metals of Groups VI, VII and VIII. Metals of particular importance for this purpose include the oxides and sulfides of molybdenum, tungsten, vanadium, chromium, iron, nickel, cobalt, palladium, and platinum type transition metals or combinations thereof. The feed hydrotreating or desulfurizing step above discussed and coupled with the downstream hydrocracking step is a high pressure operation which permits the cascade of pressured feed and desulfurized product directly from one step to the other at a suitable elevated temperature and pressure and through the sequence of exothermic catalyst bed steps in the combination of reaction zones without requiring intermediate pressurization between catalyst beds or steps. Thus, a pressure drop is enountered between the inlet to the desulfurizing zone and the high pressure separation of hydrocracked product downstream of the hydrocracking zone.

The combination operation of this invention is more specifically discussed below.

FIG. 1 is a diagrammatic block flow arrangement of primary components of the combination process of the invention comprising fluid catalytic cracking, hydrocracking, product and feed separation devices interconnected by transfer conduits for passing select fractions to and from the FCC and hydrocracking operations. The combination process also contemplates the inclusion of catalytic reforming, alkylation and product gas separation and recovery of components thereof having use in the combination operation as more fully discussed below.

In the integrated process arrangement of FIG. 1, a crude oil charged to the process by conduit 2 is desalted by one or more methods and means known in the art and comprising in one embodiment two stages of desalting, 4 and 6 with or without sodium hydroxide addition between stages by conduit 8 to the crude oil charge passed from stage 4 to 6 by conduit 10. In some cases, when the chloride level in the crude unit overhead tail water is found below about 20 ppm, there is no need to add any caustic between desalting stages. A desalted crude oil is recovered and passed by conduit 12 to a preatmospheric fractionation or flash separation zone 14. In zone 14, a rough separation is made to particularly recover $C_6$ minus hydrocarbons overhead by conduit 16 from a higher boiling crude oil portion charged thereto and comprising $C_6$ plus hydrocarbons of the charged high boiling crude oil comprising a vacuum bottoms portion. The $C_6$ plus portion of the crude oil comprising components boiling above about 1025° F. is then passed by conduit 18 to a separate atmospheric distillation zone or tower 20. In atmospheric distillation zone 20, a separation is made to recover gasoline boiling range material by conduit 22 boiling in the range of 150° F. up to about 400° F. The end point of this gasoline fraction may be varied considerably within the range of about 320° F. up to about 420° F., it being preferred to limit the end boiling point within the range of 380° F. to about 400° F. A middle distillate fraction boiling above gasoline and generally boiling initially in the range of about 320° F. to 400° F. up to about 600° F. to 700° F. is recovered from tower 20 by conduit 24 for use as desired or catalytic processing as more fully discussed below. It is to be understood that the boiling range of this middle distillate fraction may be varied with respect to its (IBP) initial boiling point depending upon the (EP) end boiling point of the gasoline fraction and its EP may be varied within the range of about 600° F. up to about 700° F., depending upon crude source and composition thereof. In a particular embodiment, the selected IBP of the middle distillate is about 400° F. so that material boiling above about 600° F. in the crude oil charged may be recovered from the bottom portion of tower 20 by conduit 26 for further catalytic processing as discussed below. A high boiling product fraction of about 400° to 600° F. IBP obtained as a product of hydrocracking as hereinafter provided is added by conduit 28 to the recovered 600° F. plus bottom fraction of the crude oil in conduit 26 for passage directly to an FCC or to a hot feed accumulator or feed mixing drum 30. The initial boiling point (IBP) of the recycled material in conduit 28 may range of about 400° F. up to about 600° F., depending upon the separation selected to be accomplished in a hydrocracked product splitter operation discussed below. In one particular operation, the splitter bottom temperature is about 550° F. and the top temperature is about 200° F. Other splitter temperature combinations may be employed depending on crude oil source and boiling range processed by the technique herein discussed.

The combined high boiling oil feed materials collected in drum 30 comprising fresh high boiling crude oil material comprising sulfur and nitrogen components as well as materials boiling above 1025° F. recovered by atmospheric distillation in combination with a high boiling product of hydrocracking is charged by conduit 32 to a fluid catalytic cracking (FCC) unit 34 for processing as herein discussed. In the combination operation of this invention, the fluid cracking performs a dual cracking function directed to catalytic conversion of the high boiling portion of crude oil passed thereto comprising material boiling above about 1025° F. at an elevated temperature approaching or at least equal to the pseudocritical temperature of the charged oil feed in combination with the high boiling 400° F. to 600° F. IBP product fraction of hydrocracking obtained as hereinafter discussed to obtain desulfurization-denitrogenation-demetallization of crude oil charged, effect hydrogen transfer reactions and product gasoline material of acceptable octane rating. The effective demetallization, desulfurization and denitrogenation of charged reduced crude in the presence of a hydrogenated product of hydrocracking contributes measurably to the economic efficiency of the operation. A cracked oil product fraction of (FCC) fluid catalytic cracking and boiling between a selected gasoline end boiling point of about 400° F. and up to a product end point of about 1000° F. is recovered as a particularly suitable hydrocracking feed charge material. The operating latitude within which the fluid cracking unit may be adjusted and operated in the presence of a hydrogenated product of hydrocracking varies considerably as a function of the source of the crude oil feed processed and the operating severity which the FCC unit is pushed or maintained to produce gasoline boiling range products and particularly a demetallized-desulfurized-denitrogenated light and heavy cycle oils particularly suitable as a hydrocracking feed as herein discussed. In a particular embodiment, it is intended to employ the fluid cracking unit at least as a gasoline producing operation as well as a feed preparation unit for a downstream hydrocracking operation. That is, high boiling cycle oil products of the fluid catalytic cracking operation obtained by converting a residual oil or reduced crude portion of a crude oil in the presence of a hydrogen donor material of hydrocracking to produce light and heavy cycle oils substantially reduced in metals, sulfur and nitrogen compounds are recovered for use as a feed charge material to a hydrocracking operation. A further significant advantage in this hydrocracker feed preparation operation of the FCC unit is in the production of a high quality gasoline product of crystalline zeolite catalytic cracking as well as feed material suitable for the hydrocracking operation over and beyond that initially separated from the crude oil feed by atmospheric distillation as discussed above. The fluid catalytic cracking operation may employ the same apparatus arrangements as that identified in copending application Ser. No. 169,086 filed July 15, 1980, the subject matter of which is incorporated by reference thereto or the cracking operation may be modified with respect to catalyst utilized as filed in copending application identified as Ser. No. 324,450, filed Nov. 24, 1981 which subject matter is also incorporated herein by reference thereto.

It is important to recognize that the combination of fluid catalytic cracking and hydrocracking as related to one another in the processing arrangement of this invention contribute in a novel manner to the conversion of polycyclic compounds to mono and dicyclic compounds, produces a hydrogenated product of hydrocracking with an IBP of 400° F. to 600° F. which provides a hydrogen donor contributing material for use in the FCC operation thereby further contributing to ultimate improvements in product selectivity of the combination operation.

The products of the fluid cracking operation obtained as herein provided are passed by conduit 36 to a product recovery zone 38. In product recovery zone 38, a separation is made to recover $C_4$ minus product material by conduit 40, a $C_4$ plus gasoline product fraction by conduit 42, a light cycle oil product stream by conduit 44, a heavy cycle oil product stream by conduit 46 and a fuel oil fraction by conduit 48. The fuel oil product fraction may be recycled to the FCC unit as desired or used as fuel in the combination process. The $C_4$ minus fraction is preferably further separated in an unsaturate gas plant and/or a cryogenic gas plant not shown to recover valuable components such as hydrogen and methane separately from higher boiling normally gaseous materials such as $C_2$, $C_3$, $C_4$ hydrocarbons. The higher boiling olefinic hydrocarbons may be alkylated as by sulfuric acid or HF alkylation techniques known in the art.

The light and heavy cycle oil products (LCO & HCO) of the fluid catalytic cracking operation are passed by conduit 50 as a combined product stream in one embodiment to a feed accumulator drum 52 wherein they may be mixed with the middle distillate fraction recovered by conduit 24 from the atmospheric main fractionator 20. Of course, the LCO and HCO recovered from column 38 may be passed alone or with middle distillate in conduit 24 directly to the hydrocracking operation. On the other hand, in yet another embodiment, a selected light cycle oil of desired boiling range may be recovered as a product of the process and only the heavier cycle oil (HCO) product charged with or without the crude oil middle distillate fraction to the hydrocracking operation. This arrangement is particularly useful when effecting the FCC operation with an ultrastable catalytic cracking catalyst identified with the operation of copending application RI 815 above incorporated herein by reference. The combined feed materials collected in drum 52 as specifically shown in the figure and comprising partially desulfurized and denitrogenated light and heavy cycle oil products of the fluid catalytic cracking operation as herein defined with or without middle distillate are passed by conduit 54 to heat exchanger 56. In heat exchanger 56, the thus formed hydrocracker-desulfurizer demetallized feed is preheated to a temperature of about 600° F. by heat exchange with a hot product effluent of hydrocracking obtained as discussed below. The preheated feed at a temperature of about 600° F. may be further heated in furnace equipment not shown to raise the temperature thereof to within the range of about 600° F. to 800° F. and suitable for effecting a temperature and pressure controlled desulfurization and denitrogenation of the feed above identified. Hydrogen obtained from catalytic reforming and other suitable process sources may be added by conduit 60 to the desulfurizer feed in conduit 58. The hydrogen addition may be before or after suitable preheating of the feed to be desulfurized and hydrocracked as herein provided. It is preferred that the oil feed and hydrogen be pressured to a pressure suitable for cascade through the operation before heating thereof by means not shown and that heating of the feed be accomplished in the presence of hydrogen.

In addition to the above it is contemplated raising the pressure of the oil feed in admixture with a substantial portion of the hydrogen used in the process separately in equipment not shown prior to admixture with one another for processing as herein defined at a temperature up to 800° F. and a pressure up to about 3000 psig. Thus sufficiently high pressure hydrogen is charged to the desulfurizing step upstream of the hydrocracking operation to permit cascade of products thereof to the hydrocracking operation in the absence of intermittent processing or pressurization. On the other hand high pressure hydrogen recovered from the product of hydrocracking in a high pressure separator may be cooled and compressed for recycle to one or both of the desulfurizing and hydrocracking steps. Sufficiently cooled hydrogen is recycled to hydrocracking to adjust product temperature conditions between catalyst beds therein as practiced in the prior art to control the temperature rise in the separate catalyst beds of the operations. Thus all of the hydrogen charged to the desulfurizing and hydrocracking operation is a distributed arrangement to maintain temperatures and pressures thereof within a pre-selected range in cooperation with providing the hydrogen consumption requirements of the process for effecting desulfurization, denitrogenation, hydrogenation of multicyclic ring compounds and lower orders of cyclic compounds including mono and dicyclic ring compounds recovered as a product of the fluid catalyst cracking and hydrocracking operations in separation equipment 20 and 38.

The recovered FCC cycle oil with or without middle distillate feed material to be hydrocracked and boiling above about 400° F. is further heated in equipment not shown following a passage through exchanger 56 to a temperature of about 650° F. to 750° F. for charge to a desulfurizing and denitrogenation reactor zone 62. Desulfurizing zone 62 is provided with one and preferably at least two sequentially arranged catalysts beds comprising for example a nickel-molybdenum or other suitable desulfurizing and denitrogenation catalyst composition also known in the prior art. Conduit means 64 is provided for adding cool hydrogen containing gas between the catalyst beds for exothermic temperature control so that the temperature of the desulfurization operation may be restricted to within the range of about 650° to 825° F. A desulfurized product comprising no more than about 10 ppm nitrogen is recovered from the hydrotreating zone 62 by conduit 66 for separation as desired or cascade passage to a hydrocracking zone 68 at a pressure below 3000 psig but above 1500 psig. In the processing arrangement of this invention, the total product effluent of the desulfurizing-denitrogenation operation is shown passed directly to the hydrocracking operation without intermittent product separation, compression operations.

Hydrocracking zone 68 comprises a plurality of sequentially arranged separate beds of hydrocracking catalyst which permits cooling of product between beds with injected cool hydrogen gas to maintain the exothermic hydrocracking temperatures within an acceptable range as herein provided. The catalyst beds may be of the same depth or of increasing depth in the direction of sequential hydrocarbon flow there through. Manifold conduit means 70 is provided for adding the cool hydrogen rich gas between catalyst beds for exothermic temperature control as above mentioned and taught in the prior art. Generally the hydrocracking operation is controlled within the temperature range of about 650° F. up to about 800° F., it being preferred to restrict the temperature below about 750° F. The pressure particularly preferred may be in the range of 1500 to 2500 psig. In the combination of hydrotreating and hydrocracking described, the relatively high boiling components of the feed and comprising an incremental variety of multicyclic ring compounds in the range of 2 to 5 rings are subjected to hydrogenation and cracking of particularly exterior rings which contribute to the ultimate production of mono and dicyclic compounds. Unconverted high boiling hydrogenated ring compounds are also converted to lower forms thereof in the FCC unit under hydrogen transfer conditions as herein discussed. Thus the hydrocracking operation provides in substantial measure a product slate comprising relatively high octane gasoline and hydrogenated fuel oil materials boiling below about 400° F. or 600° F. according to choice in combination with the recovery of higher boiling materials for use as No. 2 fuel oils or to effect catalytic conversion thereof as herein provided.

In the specific arrangements of the drawing, a high temperature effluent product of hydrocracking is recovered by conduit 72 for passage through heat exchanger 56 wherein the high temperature effluent exchanges heat with the feed charged thereto by conduit 54. In heat exchanger 56 the product is cooled to about 400° F. before passage by conduit 74 to heat exchanger 76 wherein a further cooling of the product of hydrocracking is accomplished to about 250° F. The cooled product is passed by conduit 78 to a high pressure separator 80 wherein high pressure hydrogen rich gas is recovered by conduit 82 from liquid product. The temperature of high pressure separator 80 is about 120° F. and a pressure of about 25 to 100 pounds below reactor pressure. A liquid product is recovered by conduit 84 and passed to a low pressure zone 86 at a pressure of about 200 to 300 psig. A $C_2$ minus product stream is separated in separator 86 and recovered by conduit 88. A liquid product of this separation step 86 is removed by conduit 90, passed through heat exchanger 76 wherein its temperature is raised to about 340° F. The product of hydrocracking thus separated and heated is recovered by conduit 92 and charged to a separation zone referred to as a splitter 94 maintained at a pressure of about 20–50 psig wherein a separation is made to recover a product fraction with an end boiling point in the range of 400° to 600° F. recovered therefrom by conduit 96 thereafter charged to prefactionator or flash zone 14 for separation as discussed above. The higher boiling product fraction separated in splitter 94 is recovered by conduit 98 for use as No. 2 fuel oil, a portion or all thereof may be recycled by conduit 100 to hydrocracking zone 68 or all or a portion thereof is passed by conduit 28 to hot drum 30 and then to fluid cracking with crude atmospheric tower bottoms as discussed above, thus completing the synergistic cyclic operation of the selective combination process particularly comprising fluid catalytic cracking and subsequent hydrocracking of 400° F. plus hydrogenated product materials as above discussed.

The unique and novel combination of cracking processing steps of this invention may be used to take advantage of one or more specific or select residual oil cracking processes designed to produce gasoline boiling range components varying in quality and yield in preference to the higher boiling cycle oils such as heavy cycle oil of reduced metals, sulfur and nitrogen content and suitable for subsequent hydrocracking upgrading to produce gasoline boiling products and hydrogenation of higher boiling material providing labile hydrogen available upon recycle to the FCC operation and contributing to improving the product selectivity obtained from the unique combination cracking operations of the present invention.

The combination operation above discussed is more fully and particularly integrated with respect to hydrogen utilization by the inclusion of catalytic reforming, alkylation, a saturated gas recovery plant and a cryogenic gas plant to also further contribute to product selectivity and yield as well as hydrogen production and recovery for utilization as herein provided.

Thus it is contemplated upgrading prticularly straight run gasoline boiling range material such as that boiling below about 400° F. with or without a product of hydrocracking and recovered from the fractionation zones 20 and 38 by conduits 22 and 42 respectively in a catalytic reforming operation not shown. The reforming operation may be a single large unit normally encompassing three sequentially arranged reaction or reforming zones or two separate smaller and parallel multi reactor reforming operations may be employed which process feeds comprising $C_6$ naphthenes in one reforming operation and feeds comprising $C_7$ plus naphthenes in the other reforming operation and high boiling gasoline product of hydrocracking. The combination process above discussed is product yield selectivity improved by incorporation of a suitable alkylation unit also not shown in the drawing of the processing combination to particularly form high octane gasoline product by the reaction of olefins recovered in the process with isobutane. The alkylation feed of $C_3$ and $C_4$ olefins are recovered primarily as a product of the fluid catalytic cracking operation and with or without a cryogenic gas plant operation discussed below. The isobutane feed is recovered from a provided saturate gas recovery plant not shown charged with materials from the hydrocracking operation, from the crude atmospheric distillation operation and from the reforming operations above discussed and from any available extraneous source. The alkylation operation may be one of sulfuric acid alkylation but more preferably is one of HF alkylation and known in the industry. High octane product of the alkylation operation is recovered for admixture with the gasoline product of fluid catalytic cracking and reforming of relatively high octane. In the combination operation of this invention the gasoline boiling range materials of the hydrocracking operation may be separately recovered or recovered with straight run material from the crude atmospheric distillation tower for reforming thereof as discussed above.

To further implement the integrated combination process of this invention, a cryogenic gas plant may be provided for upgrading a hydrogen product stream of the refining operation obtained from fluid catalytic cracking, hydrocracking and reforming and from available off gas streams such as might be obtained from adjacent petrochemical operations. Thus the feed charged to the cryogenic operation may be substantially any dry gas feed material comprising hydrogen, nitrogen, CO, paraffins and olefins that are soluble in relatively light condensed hydrocarbons at low temperature and a pressure in the range of 300 to 650 psig. The cryogenic separation operation provided, thus is relied upon to provide a high purity hydrogen stream, a methane rich stream for use as refinery fuel, an ethane/ethylene stream separated from higher boiling olefins for petrochemical upgrading, an olefin rich stream comprising $C_3$ and $C_4$ olefins suitable as charge material to the alkylation operation of the combination process. Hydrogen recovered from the combination operation is thus available to form a pool thereof for use in the reforming and/or hydrocracking steps of the combination operation.

It will be recognized by those skilled in the art that the above discussed operations of reforming, alkylation, saturate and cyrogenic gas plant separation facilities all contribute measurable to the integrated combination operation for the reasons herein discussed and particularly associated with upgrading $C_4$ minus products to gasoline boiling range components and the recovery of hydrogen rich gas from product gas sources for distributed use within the combination operation where appropriately needed. In addition to the above, hydrogen accumulation and distribution operations each of the reforming, and hydrocracking steps comprise built in recycle operations with respect to separated hydrogen rich gas streams and unreacted feed materials for redistribution in the particularly integrated catalytic reforming and cracking operation of this invention and particularly directed to upgrading crude oils, selected portions of crude oils, combinations of crude oils including reduced crudes, residual or reduced portions thereof.

It will be particularly recognized by those skilled in the art that the novel processing distribution of hydrocarbon fractions and utilization of hydrogen available in the crude oil feed considerably improves product selectivity and yield of quality product is enhanced. Thus the efficiency and economics of the gasoline producing combination of this invention is substantially improved over that of any known prior art combination of processing steps comprising FCC, hydrocracking, reforming, alkylation, gas plant separation operations and related product separation and recovery facilities.

Having thus generally discussed the improved combination process of this invention and described specific embodiments in support thereof, it is to be understood that no undue restrictions are to be imposed by reasons thereof except as defined by the following claims.

We claim:

1. A method for converting a reduced crude oil comprising multicyclic ring compounds boiling above 1025° F. which comprises, converting a 600° F. plus fraction of a reduced crude oil comprising sulfur, nitrogen, and metal contaminants in admixture with a hydrogen donor material of hydrocracking boiling above 400° F. to 600° F. with a fluid zeolite cracking catalyst at an elevated temperature sufficient to effect conversion of the mixed oil feed within the range of 50–85 vol. % producing light and heavy cycle oils, hydrotreating and hydrocracking said cycle oil products at a temperature below 800° F. and a pressure above 1500 psig to produce gasoline and higher boiling hydrogen donor material charged to said fluid catalytic cracking operation.

2. A process for upgrading crude oils which comprises separating said crude oil to recover a middle distillate fraction thereof from a higher boiling residual oil, catalytically cracking said higher boiling residual oil in admixture with a hydrogen donor material in a fluid catalytic cracking zone at a temperature approaching the pseudo-critical temperature of said mixed feed material comprising residual oil and hydrogen donor material, recovering cycle oil products tained under operating conditions selected to hydrogenate and crack multicyclic ring compounds to form ring compounds of a lower order including mono and dicyclic ring compounds, recovering gasoline boiling range products from each of said fluid cracking and hydrocracking operations, recovering a product of said hydrocracking operation comprising multicyclic ring compounds boiling above about 400° F. as a hydrogen donor material and passing said hydrogen donor material to said fluid catalytic cracking operation with said high boiling residual oil portion of said crude oil.

3. A combination process for upgrading crude oil comprising metallo-organic compounds boiling above 1020° F. which comprises catalytically converting a desalted residual crude oil product in a fluid catalytic cracking unit in the presence of a cycle oil product of hydrocracking boiling above about 400° F., recovering gasoline and lower boiling range products of said fluid cracking operation separately from cycle oil products boiling above about 400° F., passing a cycle oil product of the fluid catalyst cracking operation through a sequence of catalyst contact steps comprising desulfurization-denitrogenation followed by hydrocracking thereof under conditions to produce hydrocracked gasoline and higher boiling hydrogenated product, separating the product of hydrocracking to provide a low boiling fraction of an EBP in the range of 400° F. to 600° F. from a higher boiling fraction, passing the higher boiling fraction to said catalytic cracking operation with said desalted crude oil products, and recovering desired constituents from said lower boiling product fraction of hydrocracking comprising gasoline, a light cycle oil and low boiling normally gaseous materials.

4. The method of claim 3 wherein the catalyst employed in the fluid catalyst cracking unit is a catalyst selected from the group consisting of ultra-stable crystalline zeolite or a rare earth exchanged zeolite comprising greater than about 25 wt. % of said zeolite.

5. The method of claim 3 wherein a cycle oil product of fluid catalytic cracking charged to hydrotreating is of reduced sulfur and nitrogen content and has an initial boiling point of about 400° F.

6. The method of claim 3 wherein desulfurization-denitrogenation of the cycle oil products of fluid cracking is accomplished under conditions to reduce residual sulfur and nitrogen to about 10 ppm before contacting a zeolite containing hydrocracking catalyst at an elevated pressure and temperature.

7. The method of claim 3 wherein desulfurization-denitrogenation and hydrocracking of the cycle oil feed is accomplished at a pressure within the range of 1500 to 3000 psig at a temperature below 800° F.

8. The method of claim 3 wherein the gasoline product of hydrocracking is separated and recovered with 400° F. minus straight run product of crude oil atmospheric distillation.

9. The method of claim 3 wherein the separated low boiling product of hydrocracking is separated to recover a fraction boiling above gasoline with a middle distillate fraction of crude oil distillation and such separated fractions are charged to said desulfurization-hydrocracking operation with said cycle oil product of fluid catalytic cracking.

10. The method of claim 3 wherein a crude oil charge is fractionated to recover a fraction boiling below gasoline, a gasoline boiling fraction, a middle distillate fraction and a fraction boiling above said middle distillate for charging with cycle oil product of hydrocracking to said fluid cracking.

11. The method of claim 10 wherein the crude oil fraction boiling above a middle distillate fraction is charged to the fluid catalyst cracking operation with a hydrogenated product of hydrocracking boiling above 400° F. and cycle oil product of said fluid catalyst cracking operation is charged with said middle distillate to said hydrotreating-hydrocracking operation.

12. The method of claim 3 wherein a normally gaseous product of fluid catalyst cracking and hydrocracking is recovered and separated to recover a hydrogen rich gas recycled to the combination operations, $C_3$–$C_4$ olefinic product is charged to catalytic alkylation with separated isobutane, and methane, propane and butane are recovered as products of the combination process.

13. The method of claim 3 wherein a low octane gasoline boiling range material separated from crude oil and gasoline product of hydrocracking are recovered and catalytically reformed to provide higher octane product for blending with alkylate and gasoline product of said fluid catlytic cracking operation, and so provided hydrogen for said hydrotreating-hydrocracking operation.

14. The method of claim 3 wherein the fluid catalyst cracking operation and the hydrocracking operation are in combination with alkylation and catalytic reforming and hydrogen in the crude oil feed is substantially adequate to provide the hydrogen requirements of the combination process.

15. In combination process comprising fluid catalytic cracking, hydrocracking, reforming, alkylation, desulfurization and related separation steps, the improvement which comprises catalytically cracking a 600° F. plus fraction of crude oil with a 400° F. plus product of hydrocracking, hydrotreating, and hydrocracking cycle oil products of said fluid catalytic cracking in the presence of a 600° F. minus middle distillate fraction of a crude oil, catalytically reforming a gasoline product of said hydrocracking and said catalytic cracking operations, recovering a hydrogen product of said catalytic cracking, reforming and hydrocracking operations, and distributing recovered hydrogen to said reforming and hydrocracking operations.

16. In a process for upgrading residual oils comprising metallo-organic compounds boiling above 1025° F. by the combination of fluid catalytic cracking and hydrocracking to produce gasoline boiling range products, the improved method for effecting the combination operation with increased gasoline product yield and reduce hydrogen consumption therein which comprises, effecting the fluid catalytic cracking of said residual oil comprising metallo-organic compounds, sulfur and nitrogen compounds in a once through fluid catalytic operation providing high yields of gasoline boiling range and gasoline forming products up to about 80 vol. % in combination with a reduced yield of cycle oil product and hydrocracking cycle oil products of fluid catalytic cracking substantially reduced in sulfur, nitrogen and metal contaminants in the presence of added hydrogen in a once through hydrotreating-hydrocracking operation maintained under operating severity conditions sufficient to produce high yields of gasoline boiling range products, and recovering gasoline products of at least 90 vol. % by said combination operation.

17. A method for converting a reduced crude oil comprising metallo-organic compounds boiling above 1025° F. which comprises, separating a 600° F. plus fraction from crude oil, passing said 600° F. plus fraction to fluid catalytic cracking operation maintained under operation severity conditions sufficient to achieve at least 80% conversion to gasoline and lower boiling products in combination with relatively small quantity of a higher boiling 400° F. plus product of low metal contaminants, sulfur and nitrogen, and hydrocracking said higher boiling product of catcracking in a once through operation under conditions of severity producing substantial yields of gasoline boiling range product.

18. The method of claim 17 wherein low boiling gaseous products of fluid catalytic cracking are subjected to alkylation.

19. The method of claim 17 wherein the gasoline product of hydrocracking is subjected to catalytic reforming.

20. The method of claim 17 wherein the hydrogen requirement for upgrading the 400° F. plus product of fluid cracking to gasoline product is less than that required to hydrogenate the 600° F. plus feed charged to fluid catalytic cracking.

* * * * *